US009243764B2

(12) United States Patent
Van Der Zande et al.

(10) Patent No.: US 9,243,764 B2
(45) Date of Patent: Jan. 26, 2016

(54) LUMINAIRE AND METHOD FOR CONTROLLING A LUMINAIRE

(75) Inventors: Bianca Maria Irma Van Der Zande, Heeze (NL); Petrus Johannes Bremer, Eindhoven (NL); Allard Feije Boer, Eindhoven (NL); Bram Michiel Hendrikus Geenen, Utrecht (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 970 days.

(21) Appl. No.: 13/392,558

(22) PCT Filed: Aug. 20, 2010

(86) PCT No.: PCT/IB2010/053761

§ 371 (c)(1),
(2), (4) Date: Mar. 29, 2012

(87) PCT Pub. No.: WO2011/024111

PCT Pub. Date: Mar. 3, 2011

(65) Prior Publication Data

US 2012/0181951 A1 Jul. 19, 2012

(30) Foreign Application Priority Data

Aug. 28, 2009 (EP) ..... 09168946

(51) Int. Cl.

| | |
|---|---|
| ***H05B 37/02*** | (2006.01) |
| ***F21S 10/02*** | (2006.01) |
| ***F21V 23/04*** | (2006.01) |
| *F21Y 101/02* | (2006.01) |

(52) U.S. Cl.

CPC ..... *F21S 10/02* (2013.01); *F21V 23/0442* (2013.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 3,793,755 | A | 2/1974 | Gersch | |
| 6,022,128 | A | 2/2000 | Chi | |
| 6,459,919 | B1 * | 10/2002 | Lys et al. | 315/291 |
| 6,601,970 | B2 | 8/2003 | Ueda et al. | |
| 2005/0213317 | A1 | 9/2005 | Lui | |
| 2007/0152674 | A1 * | 7/2007 | Hubbell | 324/509 |
| 2008/0151563 | A1 | 6/2008 | Chen | |

(Continued)

FOREIGN PATENT DOCUMENTS

| | | | |
|---|---|---|---|
| CN | 1420302 | A | 5/2003 |
| CN | 2012246608 | Y | 5/2009 |
| DE | 19924133 | A1 | 11/2000 |

(Continued)

*Primary Examiner* — Long Nguyen

(74) *Attorney, Agent, or Firm* — Meenakshy Chakravorty

(57) ABSTRACT

The present invention refers to a luminaire comprising a plurality of directed light sources arranged in a surface of a three-dimensional body and a controller for controlling the operational state of the luminaire. The controller comprises a three-dimensional touch-sensitive surface. Each point on the touch-sensitive surface is allocated to a position of the body surface such that an operational state of at least one light source at a position of the body surface is changeable by touching a point on the touch-sensitive surface allocated to this position. A corresponding method for controlling a luminaire comprises the steps of detecting a touch at a point on a three-dimensional touch-sensitive surface and changing an operational state of at least one light source at a position of the body surface allocated to the touch point on the touch-sensitive surface.

19 Claims, 2 Drawing Sheets

(56) References Cited

U.S. PATENT DOCUMENTS

| | | | |
|---|---|---|---|
| 2008/0284747 | A1 | 11/2008 | Kuo et al. |
| 2009/0122524 | A1 | 5/2009 | Yang |

FOREIGN PATENT DOCUMENTS

| | | | | |
|---|---|---|---|---|
| EP | 0438100 | A1 | | 7/1991 |
| EP | 1467141 | A2 | | 10/2004 |
| GB | 2-358-296 | | * | 7/2001 |
| GB | 2358296 | A | | 7/2001 |
| JP | 8055508 | A | | 2/1996 |
| JP | 8104170 | A | | 4/1996 |
| JP | 4214689 | B2 | | 3/2003 |
| JP | 4066649 | B2 | | 6/2003 |
| JP | 2005514755 | A | | 5/2005 |
| JP | 2006086094 | A | | 3/2006 |
| JP | 2006120571 | A | | 5/2006 |
| JP | 2006299586 | A | | 11/2006 |

* cited by examiner

LUMINAIRE AND METHOD FOR CONTROLLING A LUMINAIRE

FIELD OF THE INVENTION

The present invention relates to a luminaire comprising a plurality of directed light sources arranged in a surface of a three-dimensional body, as well as to a method for controlling a luminary of this kind.

BACKGROUND OF THE INVENTION

Luminaires are known in a large variety of designs, being equipped with a number of light sources to illuminate a room and to create a pleasant atmosphere. Different kinds of light sources can be provided for different tasks. For example, a luminaire can comprise one or more directed light sources as a reading light and/or another light source to create an ambient light to illuminate the room. These different light sources of the luminaire can be controlled independently by corresponding control device.

In most cases the control devices for such luminaires provide a simple construction with on/off switches or dimming/boosting devices to change the light intensity of the different light sources. With an increasing number of light sources, the construction of the control device necessarily becomes more complex, making it more difficult to control the luminaire as desired, especially when additional parameters of the operational state of the light sources shall be controlled, like for example, color, hue and saturation. Incorporating a large variety of lighting functions into one luminaire, like the integration of various task lights and lights for atmosphere creation, almost necessarily goes along with increasing complexity of control. However, it is desired to control the direction of the task lights integrated into the luminaire easily. This is especially the case with LEDs as directed light sources, which offer a large variety of functions to change these light conditions.

On the other hand, user friendliness is an item of increasing importance in the consumer market. Especially in the senior market for elderly people, it is highly important to offer products which can be controlled easily in an intuitive way. The user interfaces for controlling such products should be based on a simple concept, even when a number of complex functions of the device in question is to be controlled. The known luminaires do not fulfill these requirements, since with an increasing number of light sources, possible lighting directions and operation parameters, the controllers become complicated to use.

It is therefore an object of the present invention to provide a luminaire wherein a large number of functions can be controlled by means of a simple user interface, which enables an intuitive way of controlling lighting functions of the luminaire. Another object lies in the creation of a simple and intuitive control method for a luminaire of the described kind, especially for a luminaire comprising a variety of lighting functions for different purposes.

SUMMARY OF THE INVENTION

The above described objects are achieved by a luminaire which comprises a plurality of directed light sources arranged in a surface of a three-dimensional body, and a controller for controlling the operational state of the luminaire manually, said controller comprising a three-dimensional touch sensitive surface, each point on the touch sensitive surface being allocated to a position on the body surface such that an operational state of at least one light source at a position of the body surface is changeable by touching a point on the touch sensitive surface allocated to this position.

The three-dimensional touch sensitive surface represents a user interface to control the different functions of the luminaire in a very intuitive way. For example, the user can simply choose one light source to be switched on by touching the corresponding point on the touch sensitive surface. By choosing the respective light source, the user also chooses a direction in which the light is emitted, depending on the position of the light source. A large number of light sources covering the surface of the three dimensional body offers a variety of lighting possibilities, for example by arranging a number of LEDs as directed light sources, which point in different directions. The user can easily choose different lighting functions, e.g. different kinds of task lights or ambient lighting for creating different atmospheres. Apart from being switched on or switched off, further operational parameters of respective light sources can be controlled with help of the touch sensitive surface. For example, the light intensity can increase together with the duration of the touch. Other light attributes of the light source may be controlled by different ways of touching the touch sensitive surface, wherein the controller is able to recognize these ways of touching and to control the light sources accordingly.

The provision of a three-dimensional touch sensitive surface which corresponds to the surface of a three-dimensional body in which the light sources are located represents a more intuitive user interface than a number of switches or the like, as they are known from conventional luminaires. Touch sensitive surfaces can also be controlled by elderly people with decreased mobility, so that the user friendliness of the luminaire according to the present invention is enhanced.

According to a preferred embodiment of the present invention, the touch sensitive surface is translucent and covers the body surface in which the light sources are located, each touch point of said touch-sensitive surface being located directly over the position of the body surface to which it is allocated.

This is an even more intuitive approach, wherein the touch points of the touch sensitive surface can be arranged directly over their allocated positions of the light sources to be controlled. The user can control the function of one light source by simply touching the surface of the luminaire at the respective position. By providing a translucent touch sensitive surface, the light emission is not effected by the user interface.

According to another preferred embodiment, the controller is provided to detect the duration of a touch on the touch sensitive surface and to change an operational state of at least one light source according to the detected duration.

In another preferred embodiment, the controller is provided to detect a sequence of touches on the touch sensitive surface, and to change an operational state of at least light source according to the detected sequence.

Such a sequence can comprise a number of touches of different duration, being separated by touch free intervals. Just as one example, each touch comprised in such a touch sequence can correspond to one illumination step of a light source, which is illuminated increasingly in a number of discrete steps.

According to another preferred embodiment, the controller is provided to change the size of a group of an illuminated light sources located at a position allocated to the touch point of the touch sensitive surface.

For example, with increasing duration of touch, the number of light sources contained in a group located at a corresponding position of the body surface is increased to increase the illumination of the luminaire at this position.

Preferably, the controller is provided to change at least one attribute of at least one light source, said attribute comprising one of intensity, color, hue and saturation.

According to another preferred embodiment, said directed light sources are provided as LEDs pointing in different directions.

A method according to the present invention for controlling a luminaire comprising a plurality of directed light sources arranged in the surface of a three-dimensional body comprises the steps of detecting at a touch point on a three-dimensional touch sensitive surface, and changing an operational state of at least one light source at a position of the body surface allocated to the touch point on said touch sensitive surface.

According to a preferred embodiment of this method, the touch sensitive surface is translucent and covers the body surface in which the light sources are located.

According to a preferred embodiment, this method comprises detecting the duration of a touch one the touch sensitive surface and changing an operational state of a at least one light source according to the detected duration.

Preferably, this method comprises detecting a sequence of touches on the touch sensitive surface, and changing an operational state of at least one light source according to the detected sequence.

According to another preferred embodiment, the method according to the present invention comprises changing the size of a group of illuminated light sources located at a position allocated to the touch point on the touch sensitive surface.

According to another preferred embodiment, this method further comprises changing at least one attribute of the said at least one light source, said attribute comprising at least one of intensity, color, hue and saturation.

Further aspects and benefits of the present invention will become apparent from the detailed description provided hereinafter. It should be understood, that the detailed description and specific examples, while indicating exemplary embodiments of the invention, are intended for purposes of illustration only and not intended to limit the scope of the invention.

BRIEF DESCRIPTION OF THE DRAWINGS

The above mentioned features, aspects and advantages of the present invention will become better understood from the following description with reference to the accompanying drawings, where.

DETAILED DESCRIPTION OF EMBODIMENTS

Figure 1:
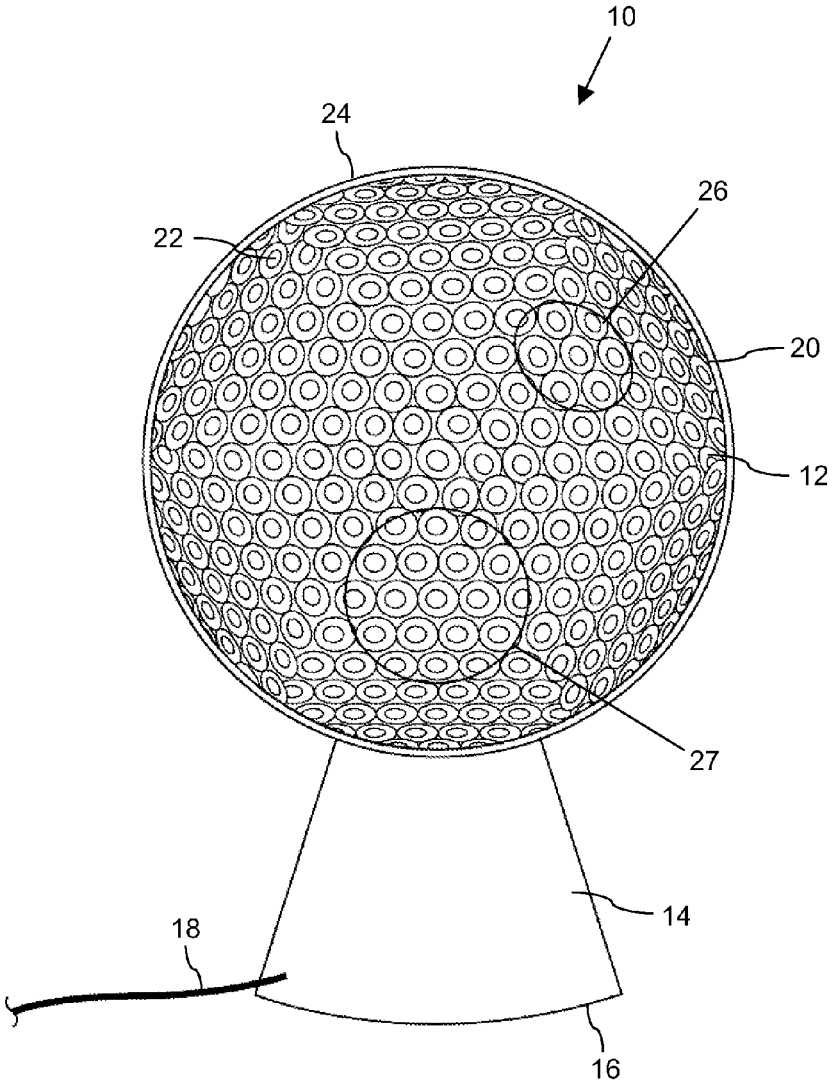
FIG. 1 is a schematic view of one embodiment of a luminaire according to the present invention.

The luminaire 10 shown in FIG. 1 basically comprises two body parts, namely a sphere 12 and a base 14 supporting the sphere 12. The base 14 serves as a stand for placing the luminaire 10 in a room on a flat underground. At its bottom, the base 14 comprises a flat resting surface 16. A power cable 18 leads from the base 14 to a power connector (not shown) to be connected with a power supply.

The spherical surface 20 of the sphere 12 is covered by LEDs, one of which is noted by reference number 22 in FIG. 1. The LEDs are arranged side by side to emit light in different directions from the luminaire 10. It is possible that neighbored LEDs 22 point in the same direction or almost in the same direction. However, there is at least a plurality of groups of LEDs 22 pointing in different directions so that light can be emitted from the sphere 12 of the luminaire 10 to illuminate different parts of the room surrounding the luminaire 10.

Each LED 22 can be addressed to be switched on or to be switched off by a controller located inside the base 14 or in the sphere 12 of the luminaire 10. The controller is able to address single LEDs 22 or groups of LEDs 22 according to an input of a user into user interface, which will be described in the following.

The user interface is provided as a touch sensitive surface 24 covering the array of LEDs 22 in the surface 20 of the sphere 12. That is, the touch sensitive surface 24 has a three-dimensional spherical form corresponding to the sphere 12. The touch sensitive surface 24 is translucent so that light emitted from the LEDs 22 can pass the touch sensitive surface 24 without substantial losses. The working principle of the touch sensitive surface 24 is commonly known. For example, the touch sensitive surface 24 can be a resistive touch sensitive panel consisting of two layers, which are separated by a gap. When the two layers are pressed together, the layers become connected at the touch point, and the panel forms a pair of voltage dividers with connected outputs. This is registered as a touch event, which is transmitted to the controller inside the luminaire 10 for further processing. Other examples of touch sensitive surface 24 to be embodied in the luminaire 10 are touch sensitive panels on the basis of surface acoustic wave (SAW) technology, capacitive panels, acoustic pulse recognition or others. The operation principle of the three-dimensional touch sensitive surface 24 as such is not part of the present invention. Any touch sensitive surface 24 can be used within the scope of the present invention, provided that the touch point on the touch sensitive surface 24 can be located to be further processed by the controller.

As one embodiment, the LEDs 22 can be embedded in a glass layer forming the surface 20 of the sphere 12 as a 3-dimensional body. This glass layer of the surface 20 can be coated by the layers forming the touch sensitive surface 24.

Each point on the touch sensitive surface 24 is allocated to a position of the body surface 20, namely to the position of the body surface 20 which is located directly under the respective touch point. When a touch point on the touch sensitive surface 24 is touched by a finger of a user or the like, the operational state of an LED 22 located at the allocated position of the surface 20 is changed. For example, an LED 22 located at a position of the body surface 20 can be switched on or switched off by touching the touch sensitive surface 24 at a touching point located directly over the respective LED 22, which is allocated to the position of the LED 22. In practice, the controller detects the touch point on the touch sensitive surface 24 and allocated this touch point to a position of the body surface 20. The corresponding LED 22 located at this position is then changed in its operational state.

Further operational states of the LEDs 22 to be changed by touching the touch sensitive surface 22 may include the light intensity emitted by the LED, its color, hue and saturation. Several ways can be provided to distinguish the different kinds of controlling the LEDs 22. For example, the controller can be provided to detect the duration of a touch on the touch sensitive surface 24 and to change an operational state of the LED 22 according to the detected duration. A typical example could be to increase the light intensity emitted by the LED 22 with increasing duration of touch. Another example is to provide a controller which is able to detect a sequence of touches on the touch sensitive surface 24. Tapping a number of times on one touch point on the touch sensitive surface 24 could increase the intensity emitted by the corresponding LED 22 stepwise, each tap on the touch point corresponding to one intensity step.

Another possibility to control the operational states of the LEDs 22 embedded in the surface 20 of the sphere 12 is to control not only one LED 22 at a position allocated to the touch point on the touch sensitive surface 24 but to control the operational state of a group of LEDs 22 located at the position allocated to the touch point. For example, touching the touch sensitive surface 24 at one touch point can change the operational state of a group of LEDs 22 centered around an LED 22 located directly under the touch point. The controller can be programmed to increase the size of the group of illuminated LEDs 22 which are located at the position which is allocated to the touch point on the touch sensitive surface 24. In this case, the user can touch the touch sensitive surface 24 once for a very short period to enlighten just one LED 22 located directly at the allocated position. When the user touches the touch point for a longer period, further LEDs 22 located around the touch point are also illuminated. The size of a group of illuminated LEDs can also be changed by a sequence of touches of the user at the desired touch point increasing the size of the group of illuminated LEDs 22 in steps.

Three examples for such groups of LEDs 22 are shown schematically in FIG. 1. In the upper right area on the surface 20 of the sphere 12, a group 26 of seven LEDs 22 is marked which could be illuminated by touching a touch point located directly on the position on the central LED 22 of this group 26. Like described above, the controller could be programmed to enlarge this group 26 of LEDs 22 by adding the next LEDs 22 around this group 24 so that a larger area on the surface 20 on the sphere 12 is illuminated. One example for such a larger group 27 is shown in the lower part of the surface 20 of the sphere 12, comprising nineteen LEDs 22.

Different LEDs 22 or groups of LEDs 22 can be illuminated at different positions of the surface 20 of the sphere 12 at the same time, for illuminating the sphere 12 at different positions. The LEDs 22 or groups of LEDs 22 form a light cone as a task light which is directed radially from the sphere 12. For example, this illuminated LED 22 or group of LEDs 22 can serve as a reading light for one user. To provide an additional reading light, a different point on the touch sensitive surface 24 can be touched to illuminate another group of LEDs 22. As there is a large number of LEDs 22 embedded in the surface of the sphere 12, there is a large number of varieties to provide different lighting situations.

An additional user device like a remote controller can be provided to supplement the touch sensitive surface 24. For example, such an additional user interface could be used to change operational parameters of the LEDs 22, which can control by the touch sensitive surface 24 only with difficulties. Such a user device could also be controlled to switch the whole luminaire 10 on or off to connect or to disconnect it from the power source.

Figure 2:
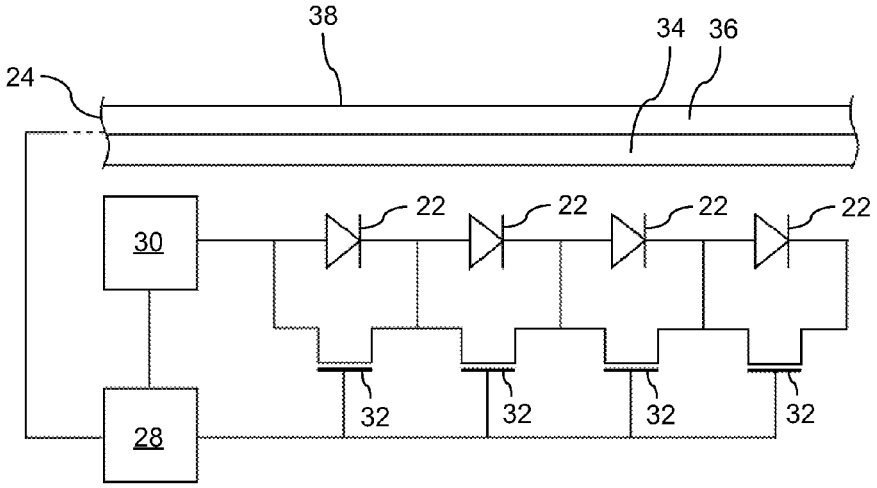
FIG. 2 is a schematic diagram of the driving circuitry of the light sources comprised in the luminaire according to FIG. 1.

One example for a circuitry to address different LEDs 22 embedded in the surface 20 is shown in FIG. 2.

In this figure a small cut-out of the surface 20 is shown schematically as a flat surface for reasons of simplicity. In reality this cut-out has a slightly convex form, as it is part of a spherical surface 20. The LEDs 22 are embedded in a glass material forming the surface 20. FIG. 2 only shows four LEDs 22, while a larger number of LEDs 22 can be controlled by one single controller.

The controller 28 is provided to generate a current control signal for controlling the operation of a current source 30 such as to set the light output of the different LEDs 22. The LEDs 22 are arranged in a series configuration, each LED 22 being controlled by a switch 32 forming a current bypass around the respective LED 22. When the switch 32 is closed, the current from the current source 20 does not pass the LED 22 and the LED 22 is turned off. The switches 32 can be provided as transistors.

The controller 28 generates switch control signals for controlling the respective switches 32 to individually control the light output of the corresponding LEDs 22. Moreover, the controller 28 generates a current control signal for controlling the operation of the current source 20. Apart from simply switching the LEDs 22 between on/off lighting states, the switches 32 can also be controlled dim the light output of the LEDs 22 by switching their current supply fast enough (e.g., with more than 25 Hz) to apply an on/off duty cycle.

Two layers 34 and 36 of a touch sensitive surface 24 cover the body surface 20 of the sphere 12. These layers 34 and 36 are separated by a narrow gap (not shown in FIG. 2). When the touch sensitive surface 24 is pressed at a touch point, the layers 34, 36 are connected, working as voltage dividers to change the electrical current through the conductive layers. This touch event is detected and registered by the controller 28, so that the touch point on the touch sensitive surface 24 can be located and allocated to a position of an LED 22 directly under the touch point.

For example, when the user touches the touch sensitive surface 24 at the point marked by reference number 38, the location of this touch point 38 is registered by the controller and allocated to an LED 22 positioned directly under the touch point 38, which is in this case the left LED 22 in the row of LEDs 22 shown in FIG. 2.

That is, the controller 28 is able to allocate each touch point 38 to a corresponding position within the surface 20 where an LED 22 is located. According to the programming of the controller 28, the controller 28 is able to illuminate the corresponding LED 22 by operating the corresponding switch 32.

It is noted that the circuitry as shown in FIG. 2 only represents a simplified form of controlling the LEDs 22 located in the surface 20. A more sophisticated circuitry can be provided to change other operation states of the LEDs 22 than simply turning the LEDs 22 on or off, like changing the illumination of the LEDs 22 or an any other lighting parameters.

The above description is intended to be merely illustrative of the present invention and should not be construed as limiting the appended claims to any particular embodiment or a group of embodiments. While the invention has been described in detail with reference to specific exemplary embodiments thereof, different modifications and changes can be made thereto without departing from the spirit and scope of the invention as set forth in the claims. The specification and drawings are accordingly to be regarded in an illustrative manner and are not intended to limit the scope of the claims. In the claims, the word "comprising" does not exclude other elements or steps, and the indefinite article "a" or "an" does not exclude a plurality. Any reference signs in the claims should not be construed as limiting the scope.

The invention claimed is:

1. A luminaire, comprising:

a plurality of directed light sources arranged over a body surface of a three-dimensional body, and a controller for enabling user control of an operational state of the luminaire, said controller comprising a three-dimensional touch-sensitive surface, wherein each point of a plurality of points on the touch-sensitive surface is allocated to a different, respective position of a plurality of positions of the body surface such that an operational state of at least one light source of the directed light sources at a corresponding position of the plurality of positions of the body surface is changeable by touching a corresponding point of the plurality of points on the touch-sensitive surface allocated to said corresponding position.

2. Luminaire according to claim 1, wherein said touch-sensitive surface is translucent and covers the surface of the three-dimensional body, each particular point of the plurality of points on said touch-sensitive surface being located directly over the respective position of the body surface to which the particular point is allocated.

3. The luminaire according to claim 1, wherein said controller is configured to detect the duration of a touch on the touch-sensitive surface and to change an operational state of at least one of the directed light sources according to the detected duration.

4. The luminaire according to claim 1, wherein said controller is configured to detect a sequence of touches on the touch-sensitive surface, and to change an operational state of at least one of the directed light sources according to the detected sequence.

5. The luminaire according to claim 1, wherein said controller is configured to change a size of a group of illuminated light sources allocated to said corresponding point.

6. The luminaire according to claim 1, wherein said controller is configured to change at least one attribute of said at least one light source, said attribute comprising at least one of intensity, color, hue and saturation.

7. The luminaire according to claim 1, wherein said directed light sources are provided as LEDs pointing in different directions.

8. The luminaire according to claim 1, wherein said plurality of points encompass said plurality of positions.

9. The luminaire according to claim 1, wherein said at least one light source is at least one first light source and wherein the controller is configured to allocate to said corresponding point a group of the directed light sources including at least one other light source of said directed light sources that is adjacent to said at least one first light source such that an operational state of the group of the directed light sources is changeable by touching said corresponding point.

10. The luminaire according to claim 9, wherein the controller is configured to add said at least one other light source to said group in response to detecting at least one of: a duration of a touch at the corresponding point on the touch-sensitive surface or a sequence of touches on the corresponding point of the touch-sensitive surface.

11. A method for controlling a luminaire comprising a plurality of directed light sources arranged over a body surface of a three-dimensional body, said method comprising:

detecting a first touch at a first point on a three-dimensional touch-sensitive surface, and changing an operational state of at least one first light source of the directed light sources at a first position of the body surface allocated to the first point on said touch-sensitive surface; and detecting a second touch at a second point on said three-dimensional touch-surface, said second point being different from said first point, and changing an operational state of at least one second light source of the directed light sources at a second position of the body surface allocated to the second point on the touch-sensitive surface.

12. The method according to claim 11, wherein said touch-sensitive surface is translucent and covers the body surface over which the light sources are located.

13. The method according to claim 11, further comprising:

detecting a duration of the first touch on the touch-sensitive surface, and changing the operational state of the at least one first light source according to the detected duration.

14. The method according to claim 11, further comprising:

detecting a sequence of touches, said sequence including the first touch, on the touch-sensitive surface, and changing the operational state of the at least one first light source according to the detected sequence.

15. The method according to claim 11, further comprising:

changing a size of a group of illuminated light sources allocated to the first point on the touch-sensitive surface.

16. The method according to claim 11, further comprising:

changing at least one of attribute of said at least one first light source, said attribute comprising at least one of intensity, color, hue and saturation.

17. The method according to claim 11, wherein each point of a plurality of points, including said first and second points, on the touch-sensitive surface is allocated to a different, respective position of a plurality of positions, including said first and second positions, of the body surface, and wherein said plurality of points encompass said plurality of positions.

18. The method according to claim 11, further comprising:

allocating to said first point a group of the directed light sources including at least one other light source of said directed light sources that is adjacent to said at least one first light source; and changing an operational state of the group of light sources.

19. The method according to claim 11, further comprising:

adding said at least one other light source to said group in response to detecting at least one of: a duration of the first touch on the first point of the touch-sensitive surface or a sequence of touches, including the first touch, on the first point of the touch-sensitive surface.

* * * * *